US008870183B2

(12) United States Patent
Takano

(10) Patent No.: US 8,870,183 B2
(45) Date of Patent: Oct. 28, 2014

(54) IMAGE FORMING APPARATUS CAPABLE OF FORMING IMAGES ON BOTH FACES OF RECORDING MEDIA

(75) Inventor: Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/585,514

(22) Filed: Aug. 14, 2012

(65) Prior Publication Data

US 2013/0049294 A1 Feb. 28, 2013

(30) Foreign Application Priority Data

Aug. 22, 2011 (JP) ..... 2011-180755
Oct. 7, 2011 (JP) ..... 2011-222795

(51) Int. Cl.

| | |
|---|---|
| ***B65H 5/02*** | (2006.01) |
| ***B65H 29/00*** | (2006.01) |
| ***G03G 15/00*** | (2006.01) |
| ***B65H 85/00*** | (2006.01) |
| ***B65H 5/06*** | (2006.01) |
| ***B41J 13/08*** | (2006.01) |
| ***B65H 9/00*** | (2006.01) |
| ***B65H 7/00*** | (2006.01) |
| ***B41J 3/60*** | (2006.01) |

(52) U.S. Cl.

CPC ..... *B65H 85/00* (2013.01); *B65H 2301/4474* (2013.01); *B65H 2301/33312* (2013.01); *B65H 5/062* (2013.01); *G03G 15/6511* (2013.01); *B41J 13/08* (2013.01); *B65H 2513/514* (2013.01); *B65H 5/021* (2013.01); *B65H 9/006* (2013.01); *B65H 7/00* (2013.01); *B65H 2404/1115* (2013.01); *B41J 3/60* (2013.01); *B65H 2513/53* (2013.01); *G03G 15/6564* (2013.01); *Y10S 271/902* (2013.01)

USPC ..... 271/275; 271/902; 271/184; 399/401

(58) Field of Classification Search

USPC ..... 271/902, 275, 65, 182, 184; 399/401

See application file for complete search history.

(56) References Cited

U.S. PATENT DOCUMENTS 5,064,182 A * 11/1991 Tokutsu ..... 271/3.17
8,121,510 B2 * 2/2012 Roppongi ..... 399/82

(Continued)

FOREIGN PATENT DOCUMENTS

JP 2001-63019 3/2001
JP 2005-148365 6/2005

(Continued)

OTHER PUBLICATIONS

U.S. Appl. No. 13/456,344, filed Apr. 26, 2012, Kuniyori Takano.

*Primary Examiner* — Patrick Cicchino

(74) *Attorney, Agent, or Firm* — Cooper & Dunham LLP

(57) ABSTRACT

An image forming apparatus includes a plurality of rotary members, a conveyance belt, an image forming device, and a switchback device. The conveyance belt is looped around the plurality of rotary members so as to circulate to intermittently feed a sheet in a sheet transport direction. The image forming device is disposed opposing the conveyance belt to form an image on the sheet fed by the conveyance belt. The switchback device is disposed downstream from the image forming device in the sheet transport direction to feed the sheet having passed the image forming device to a position downstream from the conveyance belt in the sheet transport direction and switch back the sheet. When the sheet is fed by the conveyance belt and the switchback device, a drive start timing of the switchback device is delayed from a drive start timing of the conveyance belt.

11 Claims, 11 Drawing Sheets

(56) References Cited

U.S. PATENT DOCUMENTS

| | | | | |
|---|---|---|---|---|
| 8,556,256 | B2 * | 10/2013 | Ito | 271/186 |
| 2009/0127776 | A1 * | 5/2009 | Dohki | 271/262 |
| 2009/0136279 | A1 * | 5/2009 | Kawabata | 399/401 |
| 2010/0207320 | A1 * | 8/2010 | Hara | 271/225 |
| 2012/0056932 | A1 | 3/2012 | Matsubara et al. | |
| 2012/0056933 | A1 | 3/2012 | Tanaka et al. | |
| 2012/0081487 | A1 | 4/2012 | Tanaka et al. | |
| 2012/0113180 | A1 | 5/2012 | Tanaka et al. | |
| 2012/0113204 | A1 * | 5/2012 | Tanaka et al. | 347/104 |
| 2012/0133707 | A1 * | 5/2012 | Kikkawa et al. | 347/30 |
| 2012/0147112 | A1 * | 6/2012 | Tanaka et al. | 347/104 |
| 2012/0155916 | A1 * | 6/2012 | Ito et al. | 399/110 |
| 2012/0162315 | A1 * | 6/2012 | Takano et al. | 347/37 |
| 2013/0193636 | A1 * | 8/2013 | Udagawa et al. | 271/162 |

FOREIGN PATENT DOCUMENTS

| | | |
|---|---|---|
| JP | 2009-119745 | 6/2009 |
| JP | 2009-126691 | 6/2009 |

* cited by examiner

IMAGE FORMING APPARATUS CAPABLE OF FORMING IMAGES ON BOTH FACES OF RECORDING MEDIA

CROSS-REFERENCE TO RELATED APPLICATION

This patent application is based on and claims priority pursuant to 35 U.S.C. §119 to Japanese Patent Application Nos. 2011-180755, filed on Aug. 22, 2011, and 2011-222795, filed on Oct. 7, 2011 in the Japan Patent Office, the entire disclosure of each of which is hereby incorporated by reference herein.

BACKGROUND

1. Technical Field

This disclosure relates to an image forming apparatus, and more specifically to an image forming apparatus capable of forming images on both faces of recording media according to an inkjet method.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus is known that uses a recording head (liquid ejection head or liquid-droplet ejection head) for ejecting droplets of ink.

Such an inkjet-type image forming apparatus may include a sheet conveyance section having a conveyance belt to convey a sheet of recording media and a sheet output section having a pair of output rollers to output the sheet, and be capable of forming (printing) images on both faces (first and second faces) of the sheet.

In a configuration described in JP-2001-063019-A, during printing on a first face of a sheet (simplex printing), the sheet is sandwiched between a pair of output rollers and fed by a conveyance belt and the pair of output rollers in a sheet output direction. When duplex printing is performed on a second face of the sheet, the sheet having an image formed (printed) on its first face is switched back by the pair of output rollers rotatable in both forward and reverse directions. The sheet is guided to a non-opposing surface of the conveyance belt not opposing an image forming section and reversed along a refeed path (reverse transport path), and the image forming section forms an image on a second face of the sheet reversed.

In addition, for example, JP-2009-119745-A proposes an image forming apparatus with a recording head (inkjet recording apparatus) to perform only simplex printing. The image forming apparatus has a conveyance belt and pairs of output rollers separately driven to prevent degradation of image quality by maintaining the accuracy of sheet feeding even if the retaining force of the conveyance belt to retain the sheet thereon decreases.

For a control process shown in, e.g., FIGS. 1 to 7 of JP-2009-119745-A, a sub scanning motor 131 for driving a conveyance belt 31 to convey a sheet 5 is synchronized with an output motor 79 for driving an output conveyance unit 7 to convey the sheet 5 for output, and a drive stop timing of a single driving period (ON time period) of the output motor 79 is delayed from a drive stop timing of a single driving period (ON time period) of the sub scanning motor 131 by a delay time t for intermittent driving. When an entry sensor 331 detects the sheet 5, the delay time t is set to be a time t1. By contrast, when the entry sensor 331 does not detect the sheet 5, the delay time t is set to be a time t2 ($t2<t1$).

Furthermore, for example, JP-2005-148365-A proposes to perform duplex printing by a pair of output rollers having no switchback function, a conveyance belt rotatable in forward and reverse directions, and a duplex unit.

In the configuration described in JP-2005-148365-A, to align a charging start position to charge an attachment belt of a conveyance device with a contact position at which the sheet transported from the duplex unit contacts the conveyance device, the feed timing at which the sheet is fed front the duplex unit is adjusted according to the arrangement of a charger relative to the duplex unit. Thus, the sheet having an image printed on its first face is reversed by the conveyance device (attachment belt) for duplex printing.

For a conventional type of image forming apparatus like that described in JP-2009-119745-A, the pairs of output rollers only output the sheet and do not switch back the sheet. Such a configuration can reduce the feeding force of the pairs of output rollers (for example, in a case of the pairs of output rollers disposed away from one another, the number of output rollers, the number of spurs, the pressure of spurs, the friction coefficient of output rollers, and the direction of grinding output rollers).

For another conventional type of image forming apparatus (inkjet recording apparatus) like that described in JP-2001-063019-A, the sheet is switched back by only the pair of output rollers. In such a configuration, if the feeding force of the pair of output rollers is set to be large and the feeding force of the sheet conveyance section (conveyance belt) is small, the sheet is strained in each sheet feeding operation (in this case, each time the sheet is intermittently fed by the pair of output rollers and the sheet conveyance section) after the sheet is sandwiched by the pair of output rollers, thus reducing the accuracy of sheet feeding or causing noise when the sheet is strained.

In a case in which the sheet conveyance section is the conveyance belt charged by a charging roller, the conveyance force of the conveyance belt is likely to decrease due to deterioration caused by environmental conditions or elapse of time, or dirt or deterioration caused by a contact with, e.g., the charging roller. In addition, in an inkjet type of image forming apparatus that conveys a printed sheet without using such a conveyance belt, paired sheet rollers may he disposed immediately downstream from the image forming section or printing section in a sheet transport direction, thus hampering setting of a large conveyance force.

BRIEF SUMMARY

In an aspect of this disclosure, there is provided an image forming apparatus including a plurality of rotary members, a conveyance belt, an image forming device, and a switchback device. The conveyance belt is looped around the plurality of rotary members so as to circulate to intermittently feed a sheet in a sheet transport direction. The image forming device is disposed opposing the conveyance belt to form an image on the sheet fed by the conveyance belt. The switchback device is disposed downstream from the image forming device in the sheet transport direction to feed the sheet having passed the image forming device to a position downstream from the conveyance belt in the sheet transport direction and switch back the sheet. When the sheet is fed by the conveyance belt and the switchback device, a drive start timing of the switchback device is delayed from a drive start timing of the conveyance belt.

In another aspect of this disclosure, there is provided an image forming apparatus including a first rotary member, a second rotary member, a support member, an image forming device, and a switchback device. The first rotary member intermittently feeds a sheet in a sheet transport direction. The second rotary member is disposed downstream from the first rotary member to receive the sheet fed by the first rotary member and feed the sheet downstream from the second rotary member in the sheet transport direction. The support member is disposed between the first rotary member and the second rotary member to support the sheet. The image forming device is disposed opposing the support member to form an image on the sheet fed by the first rotary member. The switchback device is disposed downstream from the second rotary member in the sheet transport direction to feed the sheet having passed the image forming device to a position downstream from the second rotary member in the sheet transport direction and switch back the sheet. When the sheet is fed by the second rotary member and the switchback device, a drive start timing of the switchback device is delayed from a drive start timing of the second rotary member.

BRIEF DESCRIPTION OF THE DRAWINGS

The aforementioned and other aspects, features, and advantages of the present disclosure would he better understood by reference to the following detailed description when considered in connection with the accompanying drawings, wherein.

Figure 1:
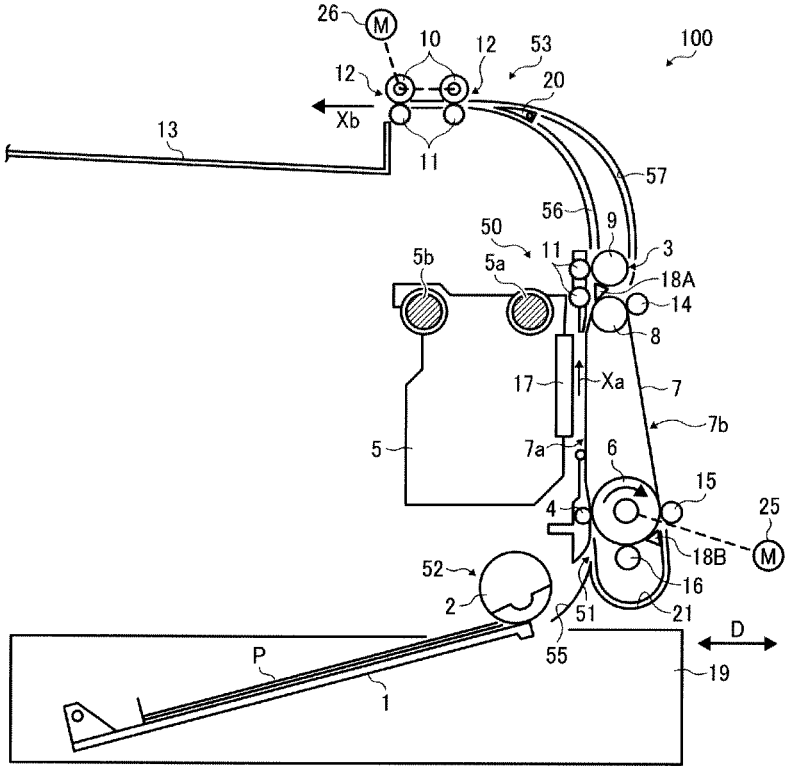
FIG. 1 is a schematic partial cross-sectional front view of an inkjet recording apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

In the following exemplary embodiments and variations, the same reference characters are allocated to elements (members or components) having the same function and shape, and redundant descriptions thereof are omitted below. For sake of simplicity and clearness, elements considered to require no specific descriptions may be omitted from drawings.

First, the entire configuration and operation of an inkjet recording apparatus serving as an example of an image forming apparatus according to a first exemplary embodiment is described with reference to FIG. 1.

FIG. 1 is a schematic view of the inkjet recording apparatus according to the first exemplary embodiment of this disclosure.

An inkjet recording apparatus 100 illustrated in FIG. 1 is a serial-type inkjet recording apparatus that forms images according to an inkjet method. The inkjet recording apparatus 100 has an image forming section 50, a conveyance section 51, a sheet feed section 52, and an output-and-reversal section 53. The image forming section 50 includes, e.g., a recording head 17 serving as an image forming device to form images according to an inkjet method. The conveyance section 51 includes, e.g., a conveyance belt 7 to convey a sheet P (also referred to as recording medium or recorded medium), and the sheet feed section 52 feeds the sheet P. The output-and-reversal section 53 serves as a sheet output device to output the sheet P having an image(s) formed (printed) thereon and a refeeding device to refeed the sheet P having an image formed on its single face (hereinafter, also referred to as "single-side printed sheet") in a switchback manner to reverse the sheet P.

A sheet feed path of the sheet P includes a sheet feed transport passage 55, a common transport passage 56, a duplex transport passage 57, and a reversal passage 21. The sheet feed transport passage 55 serves as a path to transport the sheet P fed from the sheet feed section 52 to the conveyance section 51. The common transport passage 56 is connected to and communicates with the sheet feed transport passage 55, and serves as a path to transport, to an area downstream from the image forming section 50, a single-side printed sheet P having an image formed on its front face (first face) or a duplex printed sheet P having images formed on both faces (i.e., in which an image has also been formed on a back face (second face) of the single-side printed sheet P switched back and refed). The duplex transport passage 57 including both a reversal passage and a refeeding passage is connected to the common transport passage 56, and guides and transports the single-side printed sheet P having been switched back and refed by two pairs of sheet output rollers 10 and 11 serving as the refeeding device, to a surface (hereinafter, non-opposing surface 7*b*) of the conveyance belt 7 at a side (non opposing side) opposite a side (opposing side) opposing (facing) the recording head 17 of the image forming section 50. The reversal passage 21 serves as a reversal path to guide the single-side printed sheet P again to a surface (hereinafter "opposing surface 7*a*") of the conveyance belt 7 at the side opposing the recording head 17, after the single-side printed sheet P passes the non-opposing surface 7*b* of the conveyance belt 7 and is reversed while bypassing an outer circumferential part of the conveyance belt 7 wound around a conveyance roller 6. As illustrated in FIG. 1, the conveyance roller 6 is disposed at an area upstream from an area opposing the recording head 7 in a traveling direction of the conveyance belt 7. The reversal passage 21 is formed in a substantially U shape so as to bypass the outer circumferential part of the conveyance belt 7 wound around the conveyance roller 6 and is also referred to as bypass passage or bypass.

Each of the sheet feed transport passage 55, the common transport passage 56, and the duplex transport passage 57, except for specifically described portions, is formed with a pair of opposing guide members and so forth.

The image forming section 50 includes a carriage 5 movable for scanning. The carriage 5 is supported by a main guide rod 5*a* and a sub guide rod 5*b* serving as guide members so as to he reciprocally slidable along a main scanning direction (a direction perpendicular to a sheet face on which FIG. 1 is printed, i.e., a direction from a front side to a hack side of the sheet face or vice versa). The main guide rod 5*a* and the sub guide rod 5*b* are fixed at the apparatus body to extend across the apparatus body. The carriage 5 is connected to a main scanning motor via a timing belt and reciprocally moved for scanning in the main scanning direction by the main scanning motor.

The carriage 5 mounts the recording head 17 serving as a liquid ejection head to eject ink droplets of different colors, e.g., yellow (Y), cyan (C), magenta (M), and black (K). The recording head 17 is disposed opposing the conveyance belt 7 and serves as an image forming device or recording device to form an image on a sheet P conveyed by the conveyance belt 7. The recording head 17 has multiple nozzles arranged in rows in a sub-scanning direction (sheet transport direction) Xa perpendicular to the main scanning direction and are mounted on the carriage 5 so as to substantially horizontally eject ink droplets. The recording head 17 has, for example, four nozzle rows to separately eject ink droplets of black (K), cyan (C), magenta (M), and yellow (Y).

The carriage 5 mounts head tanks to supply the respective color inks to the corresponding nozzle rows of the recording head 17. A supply pump unit supplies (replenishes) inks serving as recording liquids of the respective colors from recording-liquid cartridges to the head tanks via supply tubes dedicated for the respective colors of recording liquids. The recording-liquid cartridges are removably mountable to a cartridge mount portion of the apparatus body.

The sheet feed section 52 includes, e.g., a base plate 1 pivotable and movable upward and downward to stack multiple sheets P, a sheet teed roller 2 to feed a topmost one of the sheets P on the base plate 1, and a separation pad to separate and feed the sheets P sheet by sheet in conjunction with the sheet feed roller 2. A sheet feed cassette 19 is removably insertable to the apparatus body in a direction indicated by an arrow D in FIG. 1. The sheet feed roller 2 is a roller of a substantially half-moon shape. The sheet feed cassette 19, the sheet feed roller 2, and the separation pad form a sheet feed unit.

A sheet P fed from the sheet feed section 52 in simplex printing or a single-side printed sheet P having been reversed in duplex printing is sent via the conveyance section 51 to a position at which the image forming section 50 opposes the recording head 17. The conveyance section 51 includes, e.g., the conveyance belt 7, the conveyance roller 6, a tension roller 8, a front end pressing roller 4, a charging roller 16, a conveyance guide plate disposed at a hack-face (inner-face) side of the opposing surface 7*a* of the conveyance belt 7, and a separation claw 18A.

The conveyance belt 7 attracts the sheet P thereon by electrostatic force and conveys the sheet P to the position opposing the recording head 17. Thus, the conveyance belt 7 serves as a conveyance member to intermittently convey the sheet P in the sheet transport direction Xa. The conveyance belt 7 is an endless belt looped around the conveyance roller 6 serving as a rotary driving member and the tension roller 8 serving as a rotary driven member so as to circulate in a belt traveling direction Xa, which is the same as the sheet transport direction (sub-scanning direction) Xa.

A driving assembly including a sub scanning motor 25 serving as a driving device or driving source rotates the conveyance roller 6 via a timing belt and a toothed pulley serving as a driving force transmission device. When the conveyance roller 6 is rotated by the sub scanning motor 25, the conveyance belt 7 circulates in the belt traveling direction Xa. As described above, in this exemplary embodiment, the conveyance belt 7 is an endless belt. It is to be noted that the conveyance belt may be a molded endless belt or an endless belt formed by connecting both ends of an open-ended belt.

The conveyance belt 7 has a single or multi layer structure. At least at a side (outer surface) contacting the sheet P and the charging roller 16, the conveyance belt 7 has an insulation layer of, for example, a resin, such as polyethylene terephthalate (PET), polyether imide (PEI), polyvinylidene fluoride (PVDF), polycarbonate (PC), ethylene tetrafluoroethylene (ETFE), or polytetrafluoroethylene (PTFE), or an elastomer not including conductivity control material to retain electric charges. In a case in which a multi layer structure is employed, the conveyance belt 7 may have a conductive layer of the above-mentioned resin or elastomer containing carbon at a side not contacting the charging roller 16.

The front end pressing roller 4 serves as a pressing member to press the conveyance belt 7 from an outer surface side (conveyance face side) of the conveyance belt 7. The front end pressing roller 4 is disposed adjacent to and upstream from the recording head 17 in the belt traveling direction Xa of the conveyance belt 7 so as to press against the conveyance roller 6 via the conveyance belt 7, thus causing the sheet P to closely contact the conveyance belt 7.

The conveyance guide plate is disposed at a position between the conveyance roller 6 and the tension roller 8 and opposing the recording head 17 inside the loop of the conveyance belt 7, and serves as a belt guide member to guide the conveyance belt 7 from the inside of the loop of the conveyance belt 7. The separation claw 18A is disposed downstream from the recording head 17 in the belt traveling direction Xa so as to press against the tension roller 8 via the conveyance belt 7, and also has a function of a separation member to separate the sheet P from the conveyance belt 7.

The charging roller 16 is disposed upstream from the conveyance roller 6 in the belt traveling direction Xa, and serves as a charger to charge the surface of the conveyance belt 7. The charging roller 16 is disposed so as to contact the outer surface (insulation layer) of the conveyance belt 7. Pressing force is applied by springs to both ends of a shaft of the charging roller 16 so that the charging roller 16 can rotate with the circulation of the conveyance belt 7.

A voltage application unit alternately applies plus outputs and minus outputs, i.e., positive and negative voltages to the charging roller 16 so that the conveyance belt 7 is charged with an alternating voltage pattern, that is, an alternating band pattern of positively-charged areas and negatively-charged areas in the sub-scanning direction Xa, i.e., the belt traveling direction. When the sheet P is fed onto the conveyance belt 7 alternately charged with positive and negative voltages, the sheet P is adhered to the conveyance belt 7 by electrostatic force and conveyed in the sub scanning direction Xa by the circulation of the conveyance belt 7.

By driving the recording head 17 in accordance with image signals under control of a controller while moving the carriage 5, ink droplets are ejected onto the sheet P, which is stopped below the recording head 17, to form one line of a desired image. Then, the sheet P is conveyed at a certain distance by the conveyance belt 7 to prepare for the next recording of another line of the image. When the controller receives a recording end signal or a signal indicating that the rear end of the sheet P has exited from a recording area of the recording head 17, the recording operation finishes.

A feed roller unit 3 is disposed downstream from the recording head 17 and immediately downstream from the conveyance belt 7 of the conveyance section 51 in the sheet transport direction to feed the sheet P separated from the conveyance belt 7 by the separation claw 18A. The feed roller unit 3 includes spurs 11 having, e.g., a star-shape cross section and a feed roller 9 (also referred to as a second conveyance roller) opposing and contacting one of the spurs 11.

The spurs 11 serving as paired rollers disposed downstream from the recording head 17 and immediately downstream from the conveyance belt 7 so as to contact (engage) one face of the sheet P opposing the recording head 17 at positions downstream from the recording head 17. In a case in which the sheet P is, for example, a plain sheet of paper, an overhead projector (OHP) sheet, a card, a postcard, an envelope, or any other thick sheet of paper, the spurs 11 simply assist the feeding of the sheet P and do not necessarily define a clearance between the face of the sheet P and the recording head 17 by sandwiching the sheet P between the feed roller 9 and the spurs 11, in other words, engaging the spurs 11 with the sheet P.

As a sheet output section to output the sheet P having image(s) formed (recorded) by the recording head 17, the inkjet recording apparatus 100 has two pairs of output rollers 12. The two pairs of output rollers serve as an output device to output the sheet P fed by the conveyance belt 7 and the feed roller unit 3 to a sheet output tray 13, a switchback device to switch back the sheet, and a refeeding device to refeed the sheet. Each pair of output rollers 12 includes a spur 11 having, e.g., a star-shape cross section and a sheet output roller 10 opposing and contacting the spur 11. An output guide member and the sheet output tray 13 are disposed downstream from the pairs of output rollers 12 in the sheet feed direction. The output guide member guides the sheet P fed by the pairs of output rollers 12, and the sheet output tray 13 stacks the sheet P output by the pairs of output rollers 12.

Next, a configuration of duplex printing is described below.

The sheet output roller 10 and the spur 11 forming each pair of output rollers 12 can perform switchback operation to switch the front and rear ends of the single-side printed sheet P, and are rotatable in both clockwise and counterclockwise directions, i.e., rotatable in both forward and reverse directions. In this exemplary embodiment, as described above, the two pairs of output rollers 12 (hereinafter, also simply referred to as "the pairs of output rollers 12") are employed to obtain such a large feeding force that the single-side printed sheet P can be reliably switched back only by the pairs of output rollers 12 having both functions of the switchback device and the output device. The sheet output rollers 10 serving as driving rollers of the pairs of output rollers 12 are connected to each other via a driving force transmission unit, e.g., a gear train including intermediate gears, so as to rotate in the same direction.

Each pair of output rollers 12 is connected to a sheet output motor 26 serving as a driving source rotatable forward and in reverse via a driving force transmission unit including, e.g., a timing belt and a toothed pulley, or a gear train, and is rotated by the sheet output motor 26.

As described above, the pairs of output rollers 12 function as the switchback device and the refeeding device to switch back the single-side printed sheet P having passed the opposing surface 7*a* of the conveyance belt 7 and feed the sheet switched back toward the recording head 17 of the image forming section 50 again. In this exemplary embodiment, the pairs of output rollers 12 are disposed at the output-and-reversal section 53 and has a function of the output device disposed at the sheet output section as a sheet output unit and a function of the above-described switchback device.

A branching claw 20 serving as a transport path switching device or a branching member pivotable around a support shaft to switch the sheet P back is disposed at a branching section of the output-and-reversal section 53 at which the common transport passage 56 branches from the duplex transport passage 57. As described above, the refeeding device is mainly formed with the pairs of output rollers 12, the duplex transport passage 57, and the branching claw 20.

A duplex feed roller 14 is disposed opposing the tension roller 8 to contact the non-opposing surface 7*b* of the conveyance belt 7 not opposing (facing) the recording head 17. A guide member is disposed near the non-opposing surface 7*b* of the conveyance belt 7 to guide the single-side printed sheet P to the non-opposing surface 7*b*.

A duplex pressing roller 15 and a separation claw 18B are disposed near an entry of the reversal passage 21. The duplex pressing roller 15 serving as a pressing member is disposed so as to press the conveyance roller 6 via the conveyance belt 7. The separation claw 18B serving as a separation member is disposed so as to press the conveyance roller 6 via the conveyance belt 7.

Below, operation of the inkjet recording apparatus 100 according to the first exemplary embodiment is described with reference to FIG. 1.

First, simplex printing (printing on, e.g., a front face serving as a first face of a sheet P) is described below. When a power switch is turned on and an operator finishes inputs of, e.g., the number of prints and scaling with keys/buttons of an operation unit, in accordance with control commands from a controller for controlling operations of the inkjet recording apparatus 100, the sheet feed section 52 turns into an activation ready state in synchronization with the image forming section 50 and the conveyance section 51. In other words, the sheet feed roller 2 and the separation pad cooperate to separate and feed a topmost one of the sheets P on the base plate 1. Furthermore, the sheet P is guided along the sheet feed transport passage 55 and sent to a nipping portion of the conveyance section 51 between the front end pressing roller 4 and the conveyance belt 7.

At this time, the conveyance roller 6 is rotated by the sub scanning motor 25, so that the conveyance belt 7 circulates in the sub-scanning direction (belt traveling direction) Xa. Then, the charging roller 16 contacts the outer surface of the conveyance belt 7 and rotates with the circulation of the conveyance belt 7. Meanwhile, the voltage application unit applies alternating voltages to the charging roller 16, thus causing the charging roller 16 to be charged in an alternative band pattern in which positively and negatively charged areas are alternately repeated at a certain width. When the sheet P is fed onto the conveyance belt 7 alternately charged with positive and negative voltages, the sheet P is adhered on the opposing surface 7*a* of the conveyance belt 7 by electrostatic force and conveyed in the sub scanning direction Xa by the circulation of the conveyance belt 7. Then, the sheet P is temporarily stopped at a printing position of the recording head 17.

The carriage 5 is driven to move in the main scanning direction (between the front side and the back side in a direction perpendicular to a printed sheet surface of FIG. 1), and the recording head 17 is driven in accordance with image signals. Thus, ink droplets are ejected onto a first face of the sheet P stopped to form one line of a desired image. After the sheet P is conveyed by the conveyance belt 7 at a certain distance, another line of the image is formed. Then, the sheet P is conveyed by the conveyance belt 7 with further rotation of the conveyance roller 6. The sheet P having the image formed on the first face (also referred to as "single-side printed sheet P" or simply "sheet P") is separated from the conveyance belt 7 by the separation claw 18A and sent by the feed roller 9 and the spurs 11 to the output-and-reversal section 53. Further, the sheet P is guided by the output guide member and fed to a downstream side in the sheet transport direction Xa.

By rotating the two pairs of output rollers 12 in forward direction, the sheet P is fed to a downstream side in a sheet output direction Xb. When the controller receives a recording end signal or a signal indicating that the rear end of the single-side printed sheet P has exited from the recording area of the recording head 17, the recording operation finishes and the sheet P is output and stacked on the sheet output tray 13.

As described above, during printing or image formation if the recording head 17, the single-side printed sheet P is fed by the two pairs of output rollers 12 having the function of the switchback device.

Next, duplex printing operation is described below.

After simplex printing is performed in the above-described way, a front end of the single-side printed sheet P is guided to nipping portions of the pairs of output rollers 12 and a rear end of the single-side printed sheet P passes the branching section of the output-and-reversal section 53. When a sensor detects that the rear end of the single-side printed sheet P has passed the branching section, the sheet output rollers 10 and the spurs 11 of the two pairs of output rollers 12 are driven to perform, e.g., reverse rotation. As a result, the sheet output rollers 10 and the spurs 11 start to rotate in reverse. Thus, switchback operation is performed to switch the front end and the back end of the single-side printed sheet P. At this time, by the branching claw 20 disposed at the branching section, the transport path of the single-side printed sheet P is switched to the duplex transport passage 57. When a sensor for detecting the switchback operation detects a front end of the single-side printed sheet P (i.e., the rear end of the sheet P before switched back), the front end of the single-side printed sheet P is transported downward along the duplex transport passage 57 in FIG. 1.

Then, the single-side printed sheet P is fed via the duplex transport passage 57 while being adhered on the non-opposing surface 7*b* of the conveyance belt 7 not opposing the recording head 17. Then, while being pressed by the duplex pressing roller 15 against the conveyance roller 6 via the conveyance belt 7, the single-side printed sheet P is conveyed and separated from the conveyance belt 7 by the separation claw 18B. The single-side printed sheet P separated from the conveyance belt 7 is guided along the reversal passage 21, passes the nipping portion between the front end pressing roller 4 and the conveyance roller 6, and is conveyed by the conveyance belt 7 to the area opposing the recording head 17 again. At this time, in the same way as the above-described way, the single-side printed sheet P is adhered to the opposing surface 7*a* of the conveyance belt 7 and conveyed to the printing area of the recording head 17.

The charging roller 16 is disposed at an inner side of the reverse passage 21, thus allowing the sheet P switched back to be consistently adhered to a freshly charged state of the conveyance belt 7. Here, further detailed descriptions of subsequent operations are omitted for simplicity, because one of ordinal skill in the art would be able to understand and execute the subsequent operations based on the above description of simplex printing.

In the inkjet recording apparatus 100 of FIG. 1 serving as an image forming apparatus capable of performing duplex printing (double-face printing), the refeeding device (including, e.g., the pairs of output rollers 12, the duplex transport passage 57, and the branching claw 20) is arranged to refeed and guide the single-side printed sheet P to the non-opposing surface 7*b* of the conveyance belt 7 not opposing the recording head 17. Such a configuration can minimize the size and cost of the image forming apparatus.

The inkjet recording apparatus 100 has a front face of the apparatus body at the right side of FIG. 1 and allows an operator to perform front operation (removal of jammed sheets, replacement of components for maintenance, insertion and removal of the sheet feed cassette 19, and sheet loading from the front face of the apparatus body) while minimizing the size of the apparatus body (machine body). To minimize the machine size and the number of components while allowing front operation, the inkjet recording apparatus 100 of FIG. 1 has the sheet transport path to form an image on a sheet by substantially horizontally ejecting ink droplets while moving the carriage 5 mounting the recording head 17 in the main scanning direction. Such a configuration allows an operator to access to the sheet feed cassette 19 from the front face of the apparatus body, and the sheet P to be output with a printed face side facing down (face-down sheet output).

An example of driving configuration in this exemplary embodiment is described with reference to FIG. 2.

Figure 2:
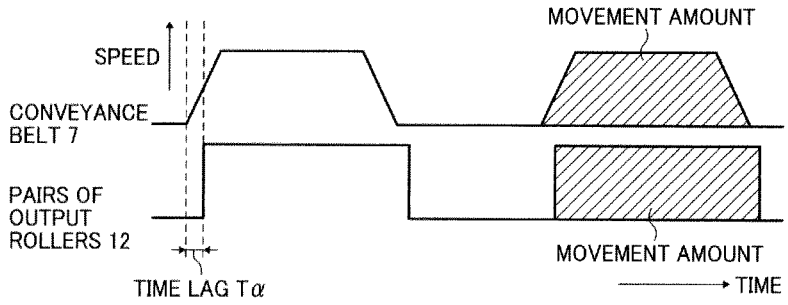
FIG. 2 is a timing chart showing drive start timings of a conveyance belt and pairs of output rollers set when a sheet is intermittently fed by the conveyance belt and the pairs of output rollers in a basic driving configuration example of the first exemplary embodiment.

FIG. 2 is a timing chart showing drive start timings of the conveyance belt 7 and the pairs of output rollers 12 when the sheet P is intermittently fed by the conveyance belt 7 and the pairs of output rollers 12. In FIG. 2, for example, the horizontal axis represents time (s) and the vertical axis represents speed (mm/s). FIG. 2 shows an example of speed profile (hereinafter, (s) and (mm/s) are omitted for simplicity, which is the same in the following timing charts of driving configuration examples).

The timing chart of FIG. 2 is an example of a configuration in which the conveyance belt 7 and the pairs of output rollers 12 are driven by separate driving sources, and more specifically, for example, the sub scanning motor 25 to drive the conveyance belt 7 is a direct current (DC) motor and the sheet output motor 26 to drive the pairs of output rollers 12 is a stepping motor. It is to be noted that, the above-described specifying of the motors is performed to make clear the difference in drive start timing between the conveyance belt 7 and the pairs of output rollers 12 in the driving configuration example of FIG. 2, and the types of driving motors are not limited to the above-described motors, which is the same in the following driving configuration examples. Hatched areas represent respective movement amounts (also represent sheet feed amounts) of the conveyance belt 7 and the pairs of output rollers 12, which are obtained by areas of respective speed profiles.

In the driving configuration example of FIG. 2, when the sheet P is intermittently fed by the conveyance belt 7 and the pairs of output rollers 12, the pairs of output rollers 12 start driving after the conveyance belt 7 starts driving. In other words, the drive start timing of the pairs of output rollers 12 is delayed from the drive start timing of the conveyance belt 7, and a time lag Tα is set between the drive start timings of the conveyance belt 7 and the pairs of output rollers 12. Setting the time lag Tα can prevent the sheet P from being strained in each sheet feeding after the sheet P is sandwiched and fed by the pairs of output rollers 12, even if the conveyance force of the conveyance belt 7 is relatively small. Such a configuration can prevent a reduction in the accuracy of sheet feeding while preventing noise that might occur when the sheet is strained.

By contrast, if the driving start point (drive start timing) of the conveyance belt 7 is set to be the same as the driving start point of the pairs of output rollers 12 without setting such a time lag Tα between the drive start timings of the conveyance belt 7 and the pairs of output rollers 12, for example, in the driving configuration example of FIG. 2, since the stepping motor is used to drive the pairs of output rollers 12, the start-up time of the driving of the pairs of output rollers 12 is faster than the start-up time of the driving of the conveyance belt 7. As a result, the pairs of output rollers 12 feed the sheet P ahead of the conveyance belt 7. Consequently, the sheet P is strained, thus reducing the accuracy of sheet feeding or causing noise.

The length of the time lag Tα can he set according to models of the inkjet recording apparatus 100 so as to obtain the above-described effect, for example, by understanding the conveyance forces of the conveyance belt 7 and the two pairs of output rollers and performing tests to confirm the effect. For example, considering that the conveyance force of the conveyance belt 7 decreases as the charging performance of the conveyance belt 7 decreases, the time lag Tα may he adjusted and controlled according to environmental conditions or the number of sheets to be printed.

Figure 3:
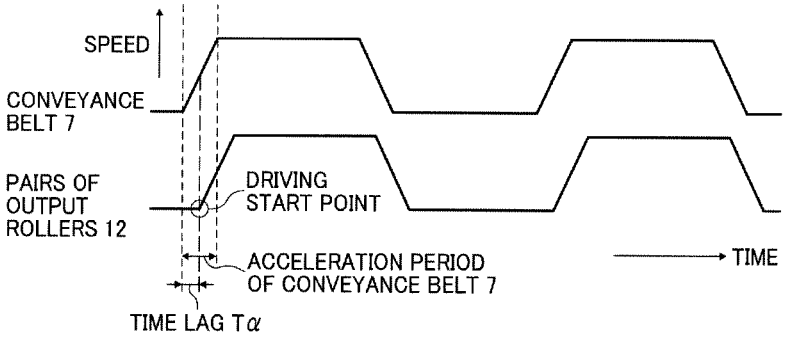
FIG. 3 is a tinting chart showing a relation between a driving start point of the pairs of output rollers and an acceleration period starting the driving of the conveyance belt.

Next, a driving configuration example of FIG. 3 is described below.

FIG. 3 is a timing chart showing a relation between a driving start point of the pairs of output rollers 12 and an acceleration period starting the driving of the conveyance belt. In FIG. 3, the driving start point of the pairs of output rollers 12 is placed in an acceleration period after the driving start point of the conveyance belt 7. Setting the driving start point of the pairs of output rollers 12 within the acceleration period of the conveyance belt 7 can prevent the sheet P from being strained regardless of the sheet types. Such a configuration can prevent a reduction in the accuracy of sheet feeding and noise that might occur when the sheet P is strained.

As described below, for example, if the driving start point (drive start timing) of the pairs of output rollers 12 is largely delayed from the driving start point of the conveyance belt 7 and the sheet P has a relatively high stiffness like a thick sheet of paper, the sheet P would not he bent in the common transport passage 56 between the conveyance belt 7 and the pairs of output rollers 12 due to the high stiffness. As a result, the sheet P slides between the pairs of output rollers 12 and the sheet feed amount of the pairs of output rollers 12 may become greater than the sheet feed amount of the conveyance belt 7, thus reducing the accuracy of sheet feeding or causing noise when the sheet P is strained.

Next, a driving configuration example of FIG. 4 is described below.

Figure 4A:
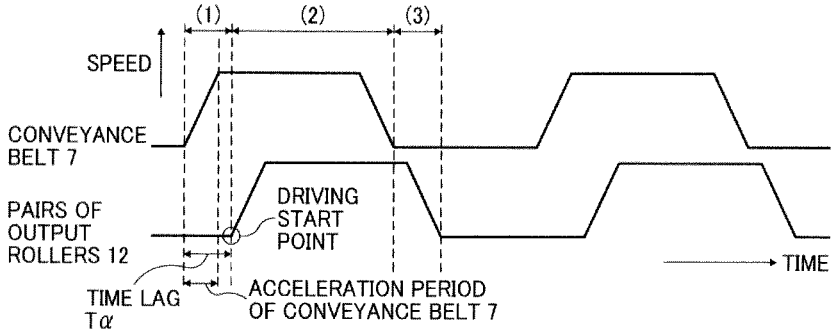
FIG. 4A is a timing chart showing a relation between a driving start point of the pairs of output rollers and a period after an acceleration period in starting the driving of the conveyance belt.
Figure 4B:
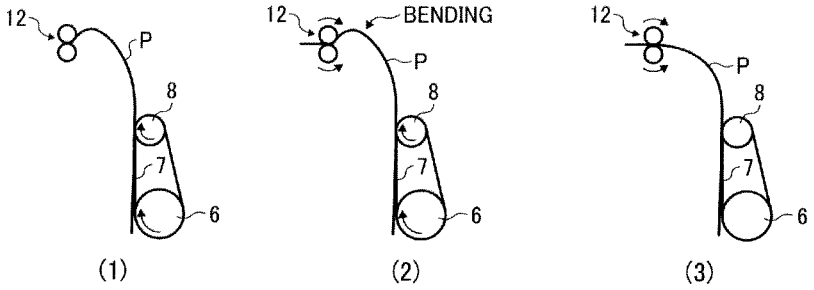
FIG. 4B shows schematic views of how a sheet is fed by the pairs of output rollers and the conveyance belt in each of periods (1) to (3) of FIG. 4A.

FIGS. 4A and 4B show a relation between the driving start point (drive start timing) of the pairs of output rollers 12 and a period after an acceleration period of the driving of the conveyance belt 7.

FIG. 4A is a timing chart showing a relation between the driving start point (drive start timing) of the pairs of output rollers 12 and a period after an acceleration period of the driving of the conveyance belt 7.

FIG. 4B shows how the sheet P is fed in periods (1) to (3) of FIG. 4A. In (1) to (3) of FIG. 4B, only one pair of output rollers 12 is illustrated and the other pair of output rollers 12 is omitted for simplicity. Specifically. FIG. 4B shows, in (1), how the sheet P is fed from when the conveyance belt 7 starts driving to before the pairs of output rollers 12 start driving. FIG. 4B shows, in (2), how the sheet P is fed from when the pairs of output rollers 12 start driving to before the conveyance belt 7 stops driving. FIG. 4B shows, in (3), how the sheet P is fed from when the conveyance belt 7 stops driving to just before the pairs of output rollers 12 stop driving.

As shown in FIG. 4A, the driving start point (drive start timing) of the pairs of output rollers 12 is set to be after the acceleration period in starting the driving of the conveyance belt 7. In other words, the drive start timing of the pairs of output rollers 12 is delayed from the acceleration period in starting the driving of the conveyance belt 7. For thin sheets or plain sheets, even if the driving start point (drive start timing) of the pairs of output rollers 12 is placed after the acceleration period of the driving of the conveyance belt 7, using the driving method of bending the sheet P as shown in FIG. 4B can prevent the sheet P from being strained. Such a configuration can prevent a reduction in the accuracy of sheet feeding and noise that might occur when the sheet P is strained.

In a sheet feeding state illustrated in (1) of FIG. 4B, only the conveyance belt 7 is driven. As a result, the sheet P is bent in the common transport passage 56 between the pairs of output rollers 12 and the conveyance belt 7. Even after the pairs of output rollers 12 start driving, the sheet P is fed in a bent state illustrated in (2) in FIG. 4B if the sheet feeding speed of the pairs of output rollers 12 is the same as that of the conveyance belt 7. In a sheet feeding state illustrated in (3) of FIG. 4B, only the pairs of output rollers 12 are driven. As a result, the pairs of output rollers 12 are driven only at a bent amount of the sheet P. It is to he noted that FIG. 4B shows one example of how the sheet P is bent, and the sheet P may not be bent as illustrated in FIG. 4B depending on the configuration of the sheet conveyance path.

For example, when the sheet P is a thick paper sheet having a high stiffness, unlike a thin paper sheet or plain paper sheet, the sheet P may not be bent in the shape illustrated in (1) of FIG. 4B depending on the configuration of the sheet conveyance path. In such a case, the sheet P may slide between the pairs of output rollers 12. If the pairs of output rollers 12 are driven at the same feeding amount as that of the conveyance belt 7 as illustrated in FIG. 4A, the pairs of output rollers 12 would strain the sheet P. Hence, a driving configuration as illustrated in FIG. 5 can be used to cope with such a case.

Figure 5:
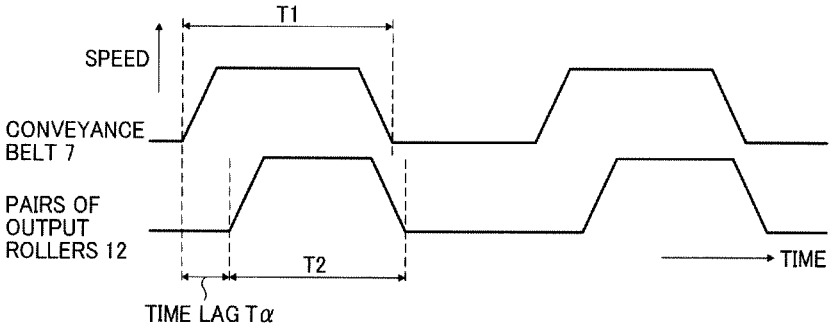
FIG. 5 is a timing chart showing a driving method (driving time) of the conveyance belt and the pairs of output rollers to feed, e.g., a thick paper sheet having a high stiffness.

Next, a driving configuration example of FIG. 5 is described below.

FIG. 5 is a timing chart showing a driving method (driving time) of the conveyance belt 7 and the pairs of output rollers 12 to feed, e.g., a thick paper sheet having a high stiffness.

In FIG. 5, T1 represents the driving time of the conveyance belt 7 (or the number of pulses of the sub scanning motor 25), and T2 represents the driving time of the pairs of output rollers 12 (or the number of pulses of the sheet output motor 26).

As illustrated in FIG. 5, the driving time T2 of the pairs of output rollers 12 is set to be shorter than the driving time T1 of the conveyance belt 7. As described above, when the sheet P is, e.g., a thick paper sheet having a high stiffness, the sheet P may not be bent in the shape illustrated in (1) of FIG. 4B depending on the configuration of the sheet conveyance path and may slide between the pairs of output rollers 12. If the pairs of output rollers 12 are driven at the same feeding amount as that of the conveyance belt 7 as illustrated in FIG. 4A, the pairs of output rollers 12 would strain the sheet P. Hence, the driving time T2 of the pairs of output rollers 12 is set to be shorter than the driving time T1 of the conveyance belt 7. Thus, even when the sheet P has a high stiffness, the sheet feed amount of the pairs of output rollers 12 can be set to be equivalent to the sheet feed amount of the conveyance belt 7. Such a configuration can prevent a reduction in the accuracy of sheet feeding and noise that might occur when the sheet P is strained.

In FIG. 5, the drive start timing of the pairs of output rollers 12 is set to be after the acceleration period of the conveyance belt 7. However, it is to be noted that, since the sheet P might slide depending on the degree (gradient) of acceleration even in the acceleration period, the drive start timing of the pairs of output rollers 12 is not limited to the above-described setting but may be any other suitable setting. (The speed profile can he changed depending on, e.g., the types of motors, and FIG. 5 shows only one example of the speed profile.) In addition, in FIG. 5, the driving stop point (drive stop timing) of the pairs of output rollers 12 is delayed from the driving stop point of the conveyance belt 7. However, it is to be noted that, the driving stop point of the pairs of output rollers 12 is not limited to the setting illustrated in FIG. 5 but may he any other suitable setting.

Figure 6:
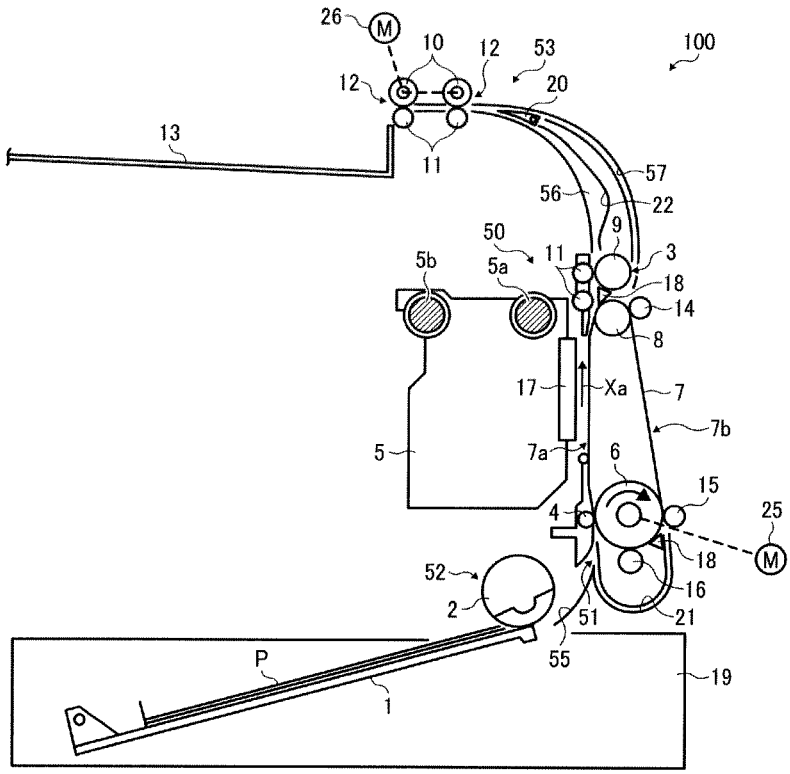
FIG. 6 is a schematic partial cross-sectional front view of the inkjet recording apparatus having a sheet bending portion at a common transport passage.

Next, a driving configuration example of FIG. 6 is described below.

FIG. 6 shows an inkjet recording apparatus 100 as an example of an image forming apparatus having a sheet bending portion 22 at a common transport passage 56. The inkjet recording apparatus 100 of FIG. 6 differs from the inkjet recording apparatus 100 of FIG. 1 in that the common transport passage 56 serving as a sheet conveyance path between a conveyance belt 7 and pairs of output rollers 12 has the sheet bending portion 22 to allow bending of the sheet P. in other words, serving as an escape region of the sheet P.

Regardless of whether the sheet P is a thin paper sheet, a plain paper sheet, or a thick paper sheet, the sheet bending portion 22 enlarges an area to which the sheet P can escape, as compared to the common transport passage 56 of FIG. 1. In addition, without adjusting the driving time of the pairs of output rollers 12 (or the number of pulses of the sheet output motor 26) as described with reference to FIG. 5, the inkjet recording apparatus 100 of FIG. 6 can prevent the sheet P from being strained, thus preventing a reduction in the accuracy of sheet feeding and noise that might occur when the sheet P is strained.

Figure 7A:
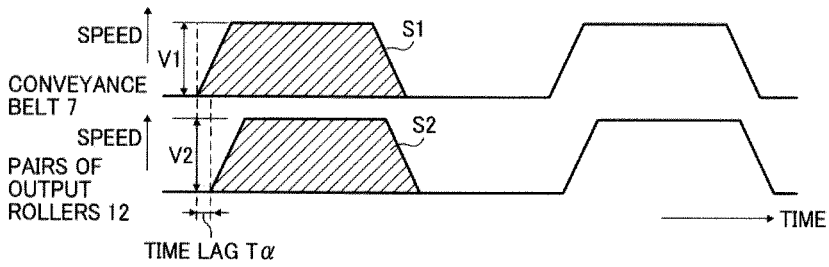
FIG. 7A is a timing chart showing a driving configuration example of the first exemplary embodiment in which the driving speed of the conveyance belt is equal to the driving speed of the pairs of output rollers.
Figure 7B:
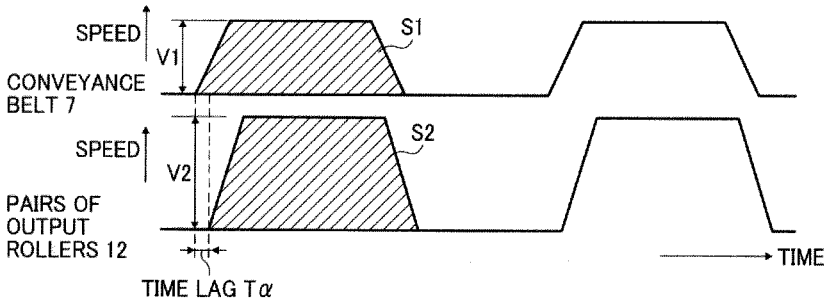
FIG. 7B is a timing chart showing a comparative example in which the driving speed of the pairs of output rollers is faster than the driving speed of the conveyance belt.

Next, a driving configuration example of FIGS. 7A and 7B is described below.

FIGS. 7A and 7B show a relation between the driving speed of the pairs of output rollers 12 and the driving speed of the conveyance belt 7.

FIG. 7A shows a driving configuration example of this exemplary embodiment in which a driving speed V1 of the conveyance belt 7 is equal to a driving speed V2 of the pairs of output rollers 12. FIG. 7B shows a comparative example in which a driving speed V2 of the pairs of output rollers 12 is faster than a driving speed V1 of the conveyance belt 7. In FIGS. 7A and 7B, S1 represents the sheet feed amount (or movement amount) of the conveyance belt 7, and S2 represents the sheet feed amount (or movement amount) of the pairs of output rollers 12. In FIGS. 7A and 7B, as in e.g., FIG. 2, a time lag Tα is set between the drive start timing of the conveyance belt 7 and the drive start timing of the pairs of output rollers 12.

In the driving configuration example of this exemplary embodiment illustrated in FIG. 7A, since the driving speed V2 of the pairs of output rollers 12 is equal to the driving speed V1 of the conveyance belt 7, there is little difference between the feed amounts S1 and S2. Such a configuration can prevent the sheet P from being strained in each feeding operation due to a difference between the driving speeds V1 and V2, thus preventing a reduction in the accuracy of sheet feeding and noise that might occur when the sheet P is strained.

By contrast, as shown in the comparative example of FIG. 7B, when the driving speed V2 of the pairs of output rollers 12 is faster than the driving speed V1 of the conveyance belt 7, the areas (sheet feed amounts) have a relation of S2>S1. As a result, the pairs of output rollers 12 would strain the sheet P, thus reducing the accuracy of sheet feeding and causing noise when the sheet P is strained.

Figure 8:
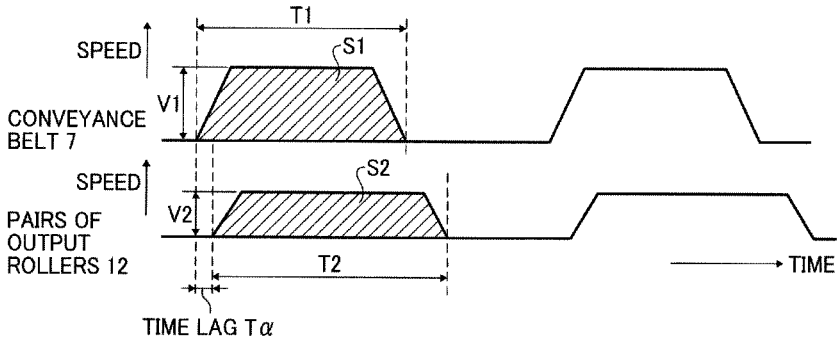
FIG. 8 is a timing chart showing a first example of a drive control method of the pairs of output rollers to prevent the sheet from being strained by the pairs of output rollers when the driving speed of the pairs of output rollers is lower than the driving speed of the conveyance belt.

Next, a driving configuration example of FIG. 8 is described below.

FIG. 8 shows a first example of drive control method of the pairs of output rollers 12 to prevent the sheet P from being strained by the pairs of output rollers 12 when the driving speed V2 of the pairs of output rollers 12 is lower than the driving speed V1 of the conveyance belt 7.

Below, with reference to FIG. 8, a description is given of the first example of drive control method of the pairs of output rollers 12 performed when the driving speed V2 of the pairs of output rollers 12 is lower than the driving speed V1 of the conveyance belt 7. As in, e.g., FIGS. 2 and 7, a time lag Tα is set between the drive start timing of the conveyance belt 7 and the drive start timing of the pairs of output rollers 12.

As illustrated in FIG. 8, the driving speed V2 of the pairs of output rollers 12 is slower than the driving speed V1 of the conveyance belt 7, and the driving time T2 of the pairs of output rollers 12 is longer than the driving time T1 of the conveyance belt 7. The sheet feed amounts (or movement amounts) of the conveyance belt 7 and the pairs of output rollers 12 are equal (S1=S2). As a result, even if the driving speed V2 of the pairs of output rollers 12 is slower than the driving speed V1 of the conveyance belt 7, the movement amounts of the sheet P moved by the conveyance belt 7 and the pairs of output rollers 12 are set to be equivalent by setting the driving time T2 of the pairs of output rollers 12 (or the number of pulses of the sheet output motor 26) to be longer (equivalent or more) than the driving time T1 of the conveyance belt 7 (or the number of pulses of the sub scanning motor 25). Such a configuration can prevent the sheet P from being strained by the pairs of output rollers 12, thus preventing a reduction in the accuracy of sheet feeding and noise that might occur when the sheet P is strained.

In addition, by adjusting the time lag Tα, the driving speeds V1 and V2, and the driving times T1 and T2, the driving of the conveyance belt 7 is stopped ahead of the driving of the pairs of output rollers 12. As illustrated in FIG. 6, the sheet bending portion 22 is provided at the common transport passage 56 between the conveyance belt 7 and the pairs of output rollers 12. Such a configuration provides an escape region of the sheet P, thus preventing a difference in sheet feeding amount of each feeding operation between the conveyance belt 7 and the pairs of output rollers 12.

Figure 9:
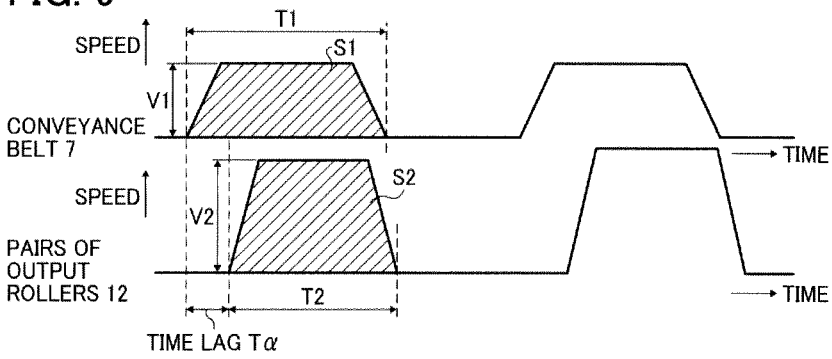
FIG. 9 is a timing chart showing a second example of a drive control method of the pairs of output rollers to prevent the sheet from being strained by the pairs of output rollers when the driving speed of the pairs of output rollers is faster than the driving speed of the conveyance belt.

Next, a driving configuration example of FIG. 9 is described below.

FIG. 9 shows a second example of drive control method of the pairs of output rollers 12 to prevent the sheet P from being strained by the pairs of output rollers 12 when the driving speed V2 of the pairs of output rollers 12 is faster than the driving speed V1 of the conveyance belt 7.

In FIG. 9, the driving speed V2 of the pairs of output rollers 12 is faster than the driving speed V1 of the conveyance belt 7, and the driving time T2 of the pairs of output rollers 12 is shorter than the driving time T1 of the conveyance belt 7. The sheet feed amounts (or movement amounts) of the conveyance belt 7 and the pairs of output rollers 12 are equal (S1=S2). As a result, even if the driving speed V2 of the pairs of output rollers 12 is faster than the driving speed V1 of the conveyance belt 7, the movement amounts of the sheet P moved by the conveyance belt 7 and the pairs of output rollers 12 are set to be equivalent by setting the driving time T2 of the pairs of output rollers 12 (or the number of pulses of the sheet output motor 26) to be shorter than the driving time T1 of the conveyance belt 7 (or the number of pulses of the sub scanning motor 25). Such a configuration can prevent the sheet P from being strained by the pairs of output rollers 12, thus preventing a reduction in the accuracy of sheet feeding and noise that might occur when the sheet P is strained.

In addition, by adjusting the time lag Tα, the driving speeds V1 and V2, and the driving times T1 and T2, the driving of the conveyance belt 7 is stopped ahead of the driving of the pairs of output rollers 12. As illustrated in FIG. 6, the sheet bending portion 22 is provided at the common transport passage 56 between the conveyance belt 7 and the pairs of output rollers 12. Such a configuration provides an escape region of the sheet P, thus preventing a difference in sheet feeding amount of each feeding operation between the conveyance belt 7 and the pairs of output rollers 12.

Next, a variation of the driving configuration example of FIG. 5 is described with reference to FIG. 10.

Figure 10:
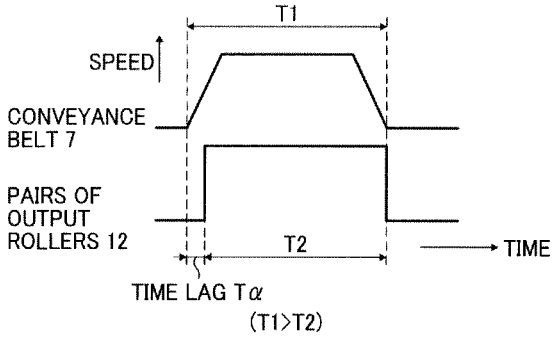
FIG. 10 is a timing chart showing a variation of a driving configuration example illustrated in FIG. 5.

The driving configuration example of FIG. 10 differs from the driving configuration example of FIG. 5 in that, as illustrated in FIG. 10, when a sheet P is intermittently fed by a conveyance belt 7 and pairs of output rollers 12, the drive stop timing of the pairs of output rollers 12 is the same as, in other words, is synchronized with the drive stop timing of the conveyance belt 7. The configuration of the driving configuration example of FIG. 10 is substantially the same as the configuration of the driving configuration example of FIG. 5 except for the above-described difference.

As illustrated in FIG. 10, in this driving configuration example, the drive stop timing of the pairs of output rollers 12 is synchronized with the drive stop timing of the conveyance belt 7, and in other words, the pairs of output rollers 12 are stopped at the same timing as the conveyance belt 7. Synchronizing the drive stop timing of the pairs of output rollers 12 with the drive stop timing of the conveyance belt 7 can prevent the sheet P from being strained, thus preventing a reduction in the accuracy of sheet feeding and noise that might occur when the sheet P is strained.

Although described below in detail, if the drive stop timing of the pairs of output rollers 12 is delayed from the drive stop timing of the conveyance belt 7, the pairs of output rollers 12 would strain the sheet after the driving of the conveyance belt 7 stops. As a result, the sheet P would not be fed according to a target feed amount, thus reducing the accuracy of sheet feeding.

Next, another variation of the driving configuration example of FIG. 5 is described with reference to FIG. 11.

Figure 11:
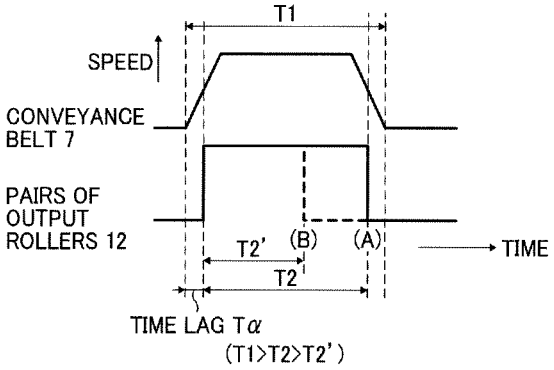
FIG. 11 is a timing chart of another variation of the driving configuration example illustrated in FIG. 5.

The driving configuration example of FIG. 11 differs from the driving configuration example of FIG. 10 in that, as illustrated in FIG. 11, when a sheet P is intermittently fed by a conveyance belt 7 and pairs of output rollers 12, the drive stop timing of the pairs of output rollers 12 is set to be during driving of the conveyance belt 7. The configuration of the driving configuration example of FIG. 11 is substantially the same as the configuration of the driving configuration example of FIG. 10 except for the above-described difference. FIG. 11 shows two cases (A) and (B) in which the drive stop timing of the pairs of output rollers 12 is different.

As described above, in the driving configuration example of FIG. 11, the drive stop timing of the pairs of output rollers 12 is set to be during the driving of the conveyance belt 7 (earlier than the drive stop timing of the conveyance belt 7). Setting the drive stop timing of the pairs of output rollers 12 within a period during which the conveyance belt 7 is driven can prevent the sheet P from being strained, thus preventing a reduction in the accuracy of sheet feeding and noise that might occur when the sheet P is strained.

Although details are described below with reference to FIG. 12, if the drive stop timing of the pairs of output rollers 12 is too early as shown in (B) of FIG. 11 (a driving time T2' of the pairs of output rollers 12 is too shorter than the driving time T1 of the driving of the conveyance belt 7), the accuracy of sheet feeding may decrease. One reason of this decrease is that, the pairs of output rollers 12 have sheet feeding force to output the sheet P by itself and switch back the sheet P, the pairs of output rollers 12 acts as a load after the driving of the pairs of output rollers 12 stops. As a result, the sheet P may not be smoothly fed between the pairs of output rollers 12, thus reducing the accuracy of sheet feeding.

Next, a case in which the drive stop timing of the pairs of output rollers 12 is earlier than the drive stop timing of the conveyance belt 7 is described with reference to FIG. 12.

Figure 12:
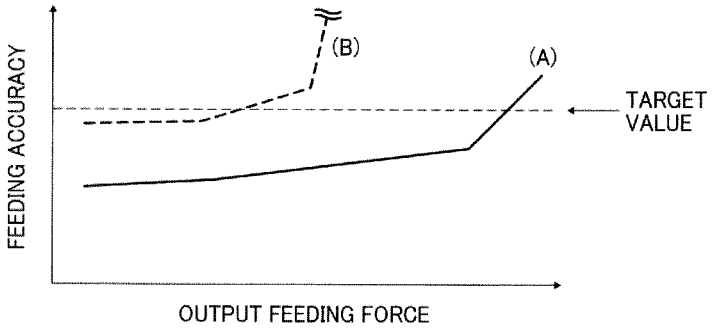
FIG. 12 is a graph chart showing a case in which the drive stop timing of the pair of output rollers is earlier than the drive stop timing of the conveyance belt.

In FIG. 12, the horizontal axis represents output feeding force and the vertical axis represents sheet feeding accuracy. FIG. 12 shows a case in which the drive stop timing of the pairs of output rollers 12 is too earlier than the drive stop timing of the conveyance belt 7. In FIG. 12, a solid line (A) and a broken line (B) represent relations between output feeding force and sheet feeding accuracy in cases (A) and (B), respectively.

The line (B) of FIG. 12 represents a relation between the output feeding force and the sheet feeding accuracy of the pairs of output rollers 12 in a case in which the drive stop timing of the pairs of output rollers 12 is too earlier than the drive stop timing of the conveyance belt 7. The greater the output feeding force of the pairs of output rollers 12, the greater the load of the pairs of output rollers 12. As a result, the sheet P cannot be smoothly fed between the pairs of output rollers 12, thus reducing the accuracy of sheet feeding relative to a target value, or the sheet P cannot he fed by the pairs of output rollers 12, thus causing a paper jam. For the line (A) of FIG. 12, as illustrated in (A) of FIG. 11, the drive stop timing of the pairs of output rollers 12 is set to be an optimal point relative to the drive stop timing of the conveyance belt 7, thus minimizing reduction in the accuracy of sheet feeding even if the output feeding force increases. This shows that the output feeding force of the pairs of output rollers 12 can he set in a relatively wide range without reducing the accuracy of sheet feeding, and even in consideration of. e.g., disturbance, it is relatively easy to make a configuration not affecting the sheet feeding accuracy.

Next, a driving configuration example in a case in which the drive stop timing of the pairs of output rollers 12 is later than the drive stop timing of the conveyance belt 7 is described with reference to FIG. 13.

Figure 13:
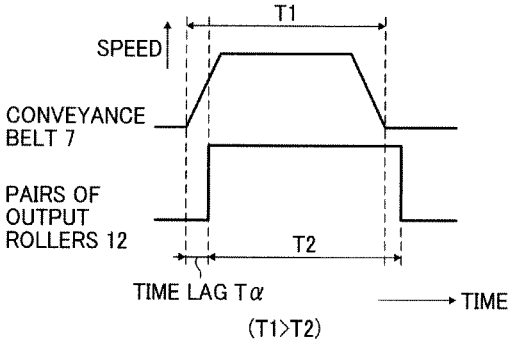
FIG. 13 is a timing chart showing a case in which the drive stop timing of the pair of output rollers is later than the drive stop timing of the conveyance belt.

The driving configuration example of FIG. 13 shows a case in which the drive stop timing of the pairs of output rollers 12 is later than the drive stop timing of the conveyance belt 7, and the driving time T2 of the pairs of output rollers 12 is shorter than the driving time T1 of the driving of the conveyance belt 7. For the driving configuration example, even if the driving time T2 of the pairs of output rollers 12 is shorter than the driving time T1 of the driving of the conveyance belt 7, the pairs of output rollers 12 may strain the sheet P after the driving of the conveyance belt 7 stops. As a result, the sheet P cannot be fed at a target feed amount, thus reducing the accuracy of sheet feeding.

As described above, in the driving configuration examples illustrated in FIGS. 10 and 11, first, when the sheet P is intermittently fed by the conveyance belt 7 and the pairs of output rollers 12, regardless of the types of sheets, the driving time T2 of the pairs of output rollers 12 is set to he shorter than the driving time T1 of the driving of the conveyance belt 7. Second, when the sheet P is intermittently fed by the conveyance belt 7 and the pairs of output rollers 12, the drive stop timing of the pairs of output rollers 12 is set to be the same as the drive stop timing of the conveyance belt 7. Third, when the sheet P is intermittently fed by the conveyance belt 7 and the pairs of output rollers 12, the drive stop timing of the pairs of output rollers 12 is set to be during driving of the conveyance belt 7. Such settings can be applied to not only the driving configuration example illustrated in FIG. 2 but also the driving configuration examples illustrated in FIGS. 3 to 9, more specifically, the driving configuration examples of FIGS. 3, 5. and 7 and the inkjet recording apparatus 100 having the sheet bending portion 22 illustrated in FIG. 6.

In a case in which the settings are applied to the inkjet recording apparatus 100 having the sheet bending portion 22 illustrated in FIG. 6, an effect partially similar to the effect described above with reference to FIG. 6 can be obtained. In other words, providing the sheet bending portion 22 can enlarge an area to which, regardless of whether the sheet P is a thin paper sheet, a plain paper sheet, or a thick paper sheet, the sheet P can escape, as compared to the common transport passage 56 of FIG. 1. In addition, even if the drive start timing of the pairs of output rollers 12 is later than the drive start timing of the conveyance belt 7 or the drive stop timing of the pairs of output rollers 12 is during driving of the conveyance belt 7, the inkjet recording apparatus 100 can prevent the sheet P from being strained, thus preventing a reduction in the accuracy of sheet feeding and noise that might occur when the sheet P is strained.

Next, inkjet recording apparatuses serving as image forming apparatuses according to exemplary embodiments of this disclosure, to which the driving configuration examples and driving methods illustrated in FIGS. 2 to 13 can be applied, are described with reference to FIGS. 14 to 17.

In the inkjet recording apparatuses according to the respective exemplary embodiments, unless confusing, the same reference characters are allocated to elements (members, components, paths, and so forth) having the same function and equivalent, even if not the same, shape, and redundant descriptions thereof are omitted below. In addition, in FIGS. 14 to 17, only one of the pairs of output rollers 12 is illustrated and, e.g., the reversal passage 21 and the sheet feed section 52 are omitted for simplicity and clarity.

Second Exemplary Embodiment

A second exemplary embodiment of this disclosure is described with reference to FIG. 14.

Figure 14:
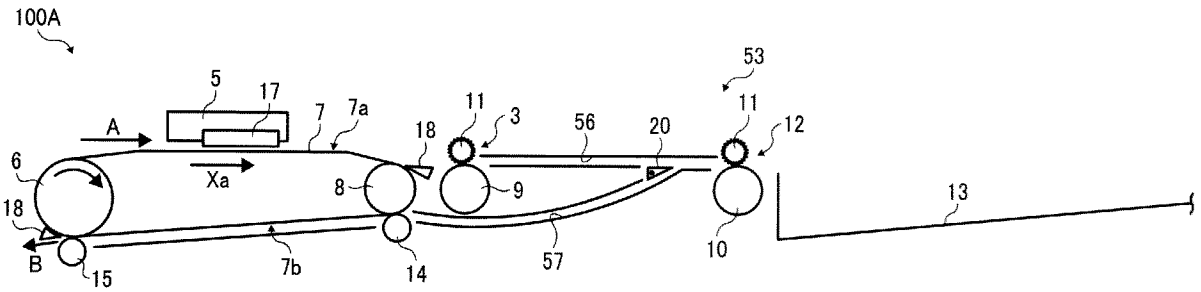
FIG. 14 is a schematic front view of an inkjet recording apparatus according to a second exemplary embodiment of this disclosure.

FIG. 14 is a schematic view of an inkjet recording apparatus 100A serving as an example of an image forming apparatus according to the second exemplary embodiment.

The inkjet recording apparatus 100A according to the second exemplary embodiment differs from the inkjet recording apparatus according to the first exemplary embodiment illustrated in FIG. 1 mainly in that, instead of the configuration of the inkjet recording apparatus 100 in which the conveyance belt 7, the feed roller unit 3, and the pairs of output rollers 12 are arranged to transport a sheet in a substantially vertically upward direction, a conveyance belt 7, a feed roller unit 3, and pairs of output rollers 12 of the inkjet recording apparatus 100A are arranged to transport a sheet in a substantially horizontal direction, and instead of the configuration of the inkjet recording apparatus 100 in which ink is ejected substantially horizontally from the recording head 17, ink is ejected vertically downward (downward in the gravitational direction) from a recording head 17 of the inkjet recording apparatus 100A. Like the two pairs of output rollers 12 of the first exemplary embodiment, the pairs of output rollers 12 of the second exemplary embodiment have functions of both an output device and a switchback device.

For the inkjet recording apparatus 100A of FIG. 14, in simplex printing, a sheet is fed in a direction (sheet feed direction) indicated by an arrow A and transported via the conveyance belt 7 and the feed roller unit 3. When the pairs of output rollers 12 are driven to perform forward rotation, the sheet is output to a sheet output tray 13. In duplex printing, as with the operation of the inkjet recording apparatus 100 illustrated in FIG. 1, by rotating the pairs of output rollers 12 in reverse and switching a sheet transport path to a duplex transport passage 57 by a branching claw 20, a single-side printed sheet is switched back and transported to the duplex transport passage 57, and adhered on and conveyed by a non-opposing surface 7*b* of the conveyance belt 7. Then, the single-side printed sheet is fed in a direction (duplex feed direction) indicated by an arrow B and refed via a reverse passage. Thus, in the inkjet recording apparatus 100A of FIG. 14, the driving configuration examples of the conveyance belt 7 and the pairs of output rollers 12 illustrated in FIGS. 2 to 13 can be used to prevent the sheet from being strained, thus preventing a reduction in the accuracy of sheet feeding and noise that might occur when the sheet is strained.

Third Exemplary Embodiment

A third exemplary embodiment of this disclosure is described with reference to FIG. 15.

Figure 15:
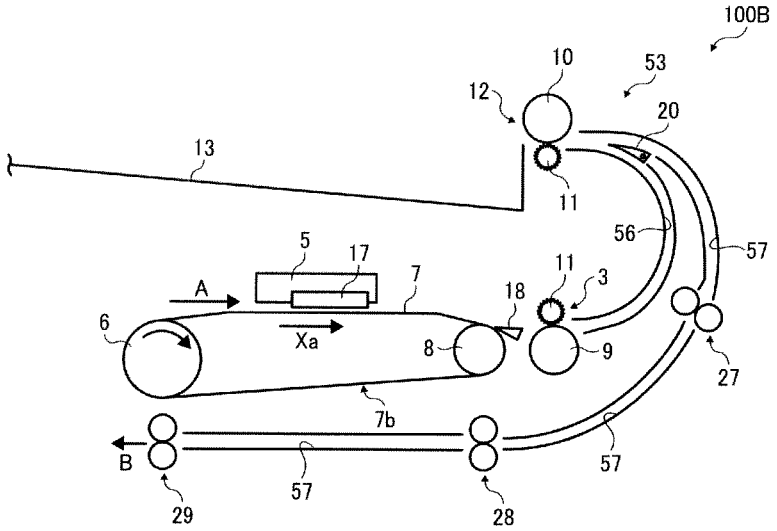
FIG. 15 is a schematic front view of an inkjet recording apparatus according to a third exemplary embodiment of this disclosure.

FIG. 15 is a schematic view of an inkjet recording apparatus 100B serving as an example of an image forming apparatus according to the third exemplary embodiment. The inkjet recording apparatus 100B according to the third exemplary embodiment differs from the inkjet recording apparatus according to the first exemplary embodiment illustrated in FIG. 1 mainly in that, instead of the configuration of the inkjet recording apparatus 100 in which the conveyance belt 7, the feed roller unit 3, and the pairs of output rollers 12 are arranged to transport a sheet in a substantially vertically upward direction, a conveyance belt 7 and a feed roller unit 3 of the inkjet recording apparatus 100B are arranged to transport a sheet in a substantially horizontal direction, and instead of the configuration of the inkjet recording apparatus 100 in which ink is ejected substantially horizontally from the recording head 17, ink is ejected vertically downward (downward in the gravitational direction) from a recording head 17 of the inkjet recording apparatus 100B. Like the two pairs of output rollers 12 of the first exemplary embodiment, pairs of output rollers 12 of the third exemplary embodiment have functions of both an output device and a switchback device.

For the inkjet recording apparatus 100B of FIG. 15, in simplex printing, a sheet is fed in a direction (sheet feed direction) indicated by an arrow A and transported via the conveyance belt 7 and the feed roller unit 3. When the pairs of output rollers 12 are driven to perform forward rotation, the sheet is output to a sheet output tray 13.

In duplex printing, as with the operation of the inkjet recording apparatus 100 illustrated in FIG. 1, by rotating the pairs of output rollers 12 in reverse and switching a sheet transport path to a duplex transport passage 57 by a branching claw 20, a single-side printed sheet is switched back and transported to the duplex transport passage 57 by pairs of duplex feed rollers 27, 28, and 29. Then, the single-side printed sheet is fed in a direction (duplex feed direction) indicated by an arrow B and refed via a reverse passage. Thus, in the inkjet recording apparatus 100B of FIG. 15, the driving configuration examples of the conveyance belt 7 and the pairs of output rollers 12 illustrated in FIGS. 2 to 13 can be used to prevent the sheet from being strained, thus preventing a reduction in the accuracy of sheet feeding and noise that might occur when the sheet is strained.

Four Exemplary Embodiment

A fourth exemplary embodiment of this disclosure is described with reference to FIG. 16.

Figure 16:
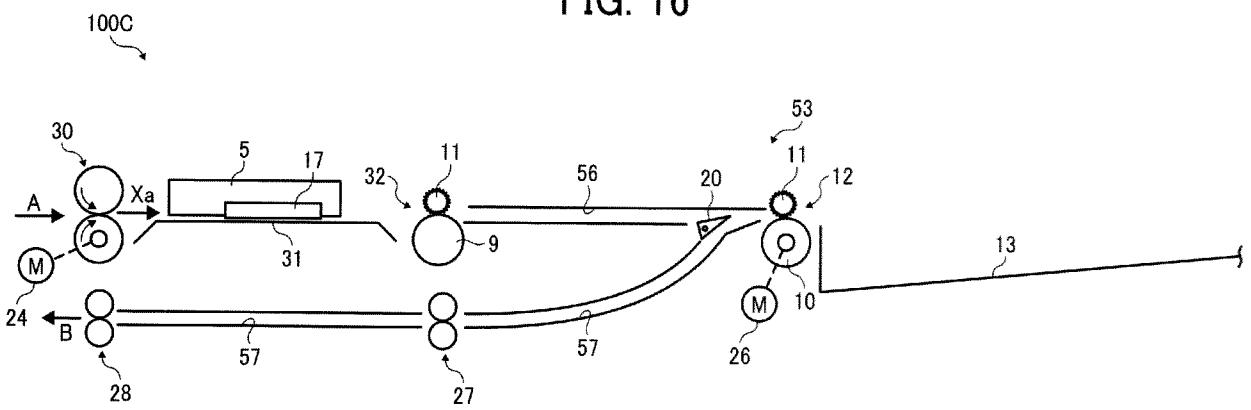
FIG. 16 is a schematic front view of an inkjet recording apparatus according to a fourth exemplary embodiment of this disclosure.

FIG. 16 is a schematic view of an inkjet recording apparatus 100C serving as an example of an image forming apparatus according to the fourth exemplary embodiment. The inkjet recording apparatus 100C according to the fourth exemplary embodiment differs from the inkjet recording apparatus 100A according to the second exemplary embodiment illustrated in FIG. 14 mainly in that, instead of the conveyance belt 7 of the inkjet recording apparatus 100A, the inkjet recording apparatus 100C has paired transport rollers 30, paired feed rollers 32, and a plurality of support members 31. The paired transport rollers 30 serving as first rotary members are disposed upstream from a recording head 17 in a sheet transport direction Xa to intermittently feed a sheet in the sheet transport direction Xa. The paired feed rollers 32 serving as second rotary members are disposed downstream from the recording head 17 in the sheet transport direction Xa to receive the sheet fed by the paired transport rollers 30 and feed the sheet to a downstream side in the sheet transport direction Xa. The plurality of support members 31 is disposed between the paired transport rollers 30 and the paired feed rollers 32 to support the sheet. The configuration of the fourth exemplary embodiment is substantially the same as the configuration of the second exemplary embodiment except for the above-described differences. Like the two pairs of output rollers 12 of the first exemplary embodiment, pairs of output rollers 12 of the fourth exemplary embodiment have functions of both an output device and a switchback device.

The paired transport rollers 30 have a configuration in which similar transport rollers contact each other to form a nipping portion to sandwich and feed a sheet. The paired feed rollers 32 have a configuration in which a feed roller 9 and a spur 11 contact each other. The paired transport rollers 30 and the paired feed rollers 32 are in drive connected relation to be rotatable via a driving force transmission unit including a timing belt and toothed pulleys. A lower driving roller of the paired transport rollers 30 is connected to a transport motor 24 via a driving force transmission unit including a timing belt and toothed pulleys, and is driven for rotation by the transport motor 24. The plurality of support members 31 is arranged at front and rear sides in a direction perpendicular to a sheet face on which FIG. 16 is printed, and has an escape area for wavy deformation (cockling) of a sheet caused by ejected ink.

Next, operation of the inkjet recording apparatus 100C is described below.

In simplex printing, a sheet is fed from a direction indicated by an arrow A, which is a sheet feed direction of a sheet feed section, to in the sheet transport direction Xa, and the sheet on the support members 31 is printed by the recording head 17 of a carriage 5 that is disposed between the paired transport rollers 30 and the paired feed rollers 32 so as to be reciprocally movable in a main scanning direction perpendicular to the sheet transport direction Xa. After printing, the sheet is fed by the paired feed rollers 32, and the pairs of output rollers 12 are driven for forward rotation to output the sheet to a sheet output tray 13. In duplex printing, in substantially the same way as the operation of the inkjet recording apparatus 100A illustrated in FIG. 14, by rotating the pairs of output rollers 12 in reverse and switching a sheet transport path to a duplex transport passage 57 by a branching claw 20, a single-side printed sheet is switched back and fed to the duplex transport passage 57 by pairs of duplex feed rollers 27 and 28. Then, the single-side printed sheet is fed in a direction (duplex feed direction) indicated by an arrow B and refed via a reverse passage.

In the driving configuration examples illustrated in FIGS. 2 to 13, driving of the conveyance belt 7 and the pairs of output rollers 12 is described. For the inkjet recording apparatus 100C of FIG. 16, the sheet might be strained depending on the relation between the paired feed rollers 32 and the pairs of output rollers 12. Hence, replacing (reading) the conveyance belt 7 of FIGS. 2 to 13 with (as) the paired feed rollers 32 of FIG. 16 can prevent the sheet from being strained by the pairs of output rollers 12, thus preventing a reduction in the accuracy of sheet feeding and noise that might occur when the sheet is strained.

Fifth Exemplary Embodiment

A fifth exemplary embodiment of this disclosure is described with reference to FIG. 17.

Figure 17:
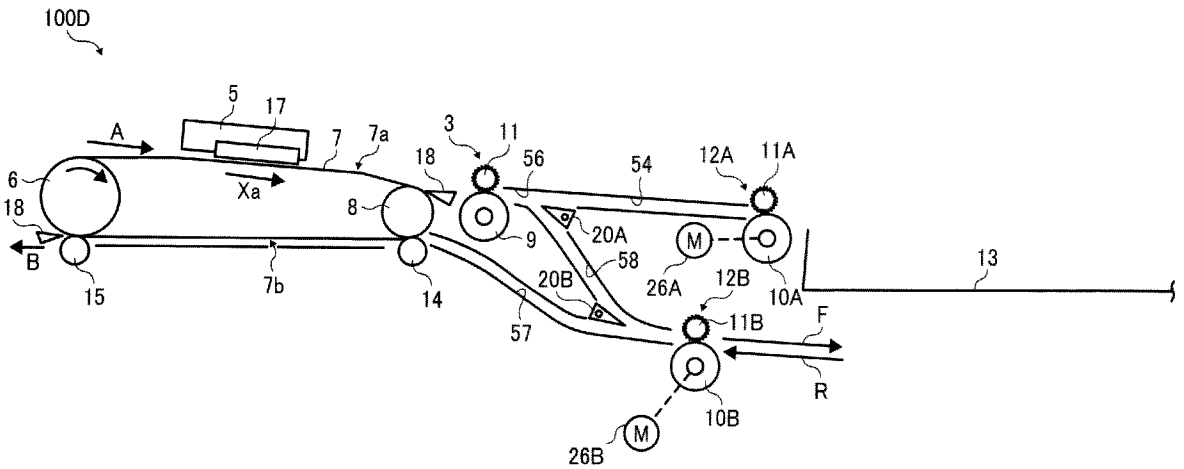
FIG. 17 is a schematic front view of an inkjet recording apparatus according to a fifth exemplary embodiment of this disclosure.

FIG. 17 is a schematic view of an inkjet recording apparatus 100D serving as an example of an image forming apparatus according to the fifth exemplary embodiment.

The inkjet recording apparatus 100D according to the fifth exemplary embodiment differs from the inkjet recording apparatus 100A according to the second exemplary embodiment illustrated in FIG. 14 mainly in the following points. First, instead of the pairs of output rollers 12 of the inkjet recording apparatus 100A having the functions of both the output device and the switchback device, the inkjet recording apparatus 100D has pairs of output rollers 12A having only a function of the output device and pairs of switchback rollers 12B having only a function of the switchback device separately. Second, the inkjet recording apparatus 100D has an output transport passage 54 and a switchback transport passage 58 that are branched from a common transport passage 56. Third, branching claws 20A and 20B are disposed at a first branching section between the output transport passage 54 and the switchback transport passage 58 and a second branching section between the switchback transport passage 58 and a duplex transport passage 57. The configuration of the fifth exemplary embodiment is substantially the same as the configuration of the second exemplary embodiment except for the above-described differences.

A lower driving roller 10A of each pair of output rollers 12A is connected to a sheet output motor 26A via a driving force transmission unit including a gear train, and driven by the sheet output motor 26A so as to rotate in a single direction, e.g., a forward rotation direction. The pairs of output rollers 12A are disposed downstream from the output transport passage 54, and are driven by the sheet output motor 26A so as to rotate in a single direction, e.g., a forward rotation direction to output a single-side printed sheet to a sheet output tray 13. The feeding force of the pairs of output rollers 12A in this exemplary embodiment is set to be smaller than the feeding force of the pairs of output rollers 12 in any of the first to fourth exemplary embodiments so that the pairs of output rollers 12A do not strain the single-side printed sheet when the single-side printed sheet is fed by the conveyance belt 7 and the pairs of output rollers 12A.

A lower driving roller 10B of each pair of switchback rollers 12B is connected to a switchback motor 26B via a driving force transmission unit including a gear train, and is driven by the switchback motor 26B so as to rotate in both forward and reverse rotations. The pairs of switchback rollers 12B are disposed downstream from the switchback transport passage 58, and driven by the switchback motor 26B so as to rotate in both the forward and reverse rotations to feed the single-side printed sheet in a direction indicated by an arrow F and switch back the sheet in a direction indicated by an arrow R in FIG. 17. It is to be noted that the sheet output motor 26A and the switchback motor 26B may be replaced with a single motor capable of rotating the lower driving rollers 10A and 10B in both forward and reverse directions and an electromagnetic clutch may be provided to selectively drive the pairs of output rollers 12A and the pairs of switchback rollers 12B.

Next, operation of the inkjet recording apparatus 100D is described below.

In simplex printing, a sheet is fed in a direction (sheet feed direction) indicated by an arrow A and transported via the conveyance belt 7 and the feed roller unit 3. Like the operation of the inkjet recording apparatus 100 of FIG. 1, the sheet is transported via the conveyance belt 7 and the feed roller unit 3 and transported to the output transport passage 54 switched by the branching claw 20A. When the pairs of output rollers 12A are driven to perform forward rotation, the sheet is output to the sheet output tray 13.

In duplex printing, like the operation of the inkjet recording apparatus 100 illustrated in FIG. 1, a single-side printed sheet transported to the common transport passage 56 via the conveyance belt 7 and the feed roller unit 3 is transported to the switchback transport passage 58 switched by the branching claw 20A. After the forward rotation, the pairs of switchback rollers I 2B are rotated in reverse to perform switchback operation, and the sheet transport path is switched to the duplex transport passage 57 by the branching claw 20B. As a result, the single-side printed sheet is switched back and transported to the duplex transport passage 57, and adhered on and conveyed by a non-opposing surface 7*b* of the conveyance belt 7. Then, the single-side printed sheet is fed in a direction (duplex feed direction) indicated by an arrow B and refed via a reverse passage.

As described above, the single-side printed sheet is switched back by the pairs of switchback rollers 12B, after, during printing (image formation) with the recording head 17, the single-side printed sheet is fed by the pairs of switchback rollers 12B to a downstream side in the sheet transport direction and a rear end of the single-side printed sheet exits out from the branching claw 20B disposed at a downstream side of the switchback transport passage 58 (near which a sensor to detect the rear end of the sheet is disposed).

In the driving configuration examples of FIGS. 2 to 13, driving of the conveyance belt 7 and the pairs of output rollers 12 is described. For the inkjet recording apparatus 100D of FIG. 17, when the single-side printed sheet is fed by the conveyance belt 7 and the pairs of switchback rollers 12B, the sheet might be strained depending on the driving relation between the conveyance belt 7 and the pairs of switchback rollers 12B. Hence, replacing (reading) the pairs of output rollers 12 illustrated in FIGS. 2 to 13 with (as) the pairs of switchback rollers 12B illustrated in FIG. 17 can prevent the sheet from being strained by the pairs of switchback rollers 12B, thus preventing a reduction in the accuracy of sheet feeding and noise that might occur when the sheet is strained.

As described above, in the driving configurations and methods of the first to fifth exemplary embodiments, the inkjet recording apparatus 100 has the pairs of output rollers 12 or the pairs of switchback rollers 12B serving as the switchback device to feed and switch back the sheet having passed the recording head 17 serving as the image forming device to an area downstream from the conveyance belt 7 or the paired feed rollers 32 in the sheet transport direction Xa. When the sheet is fed by the switchback device (the pairs of output rollers 12 or the pairs of switchback rollers 12B) and one of the conveyance belt 7 and the paired feed rollers 32, the drive start timing of the switchback device (the pairs of output rollers 12 or the pairs of switchback rollers 12B) is delayed from the drive start timing of the conveyance belt 7 or the paired feed rollers 32. It is to be noted that the driving configuration is not limited to the fifth exemplary embodiment. For example, instead of the conveyance belt 7 of the fifth exemplary embodiment, the paired transport rollers 30 and the paired feed rollers 32 of the fourth exemplary embodiment may be employed to form another exemplary embodiment differing from the fifth exemplary embodiment.

Although the specific exemplary embodiments, driving configuration examples, and driving methods are described above, it is to be noted that the art disclosed in the present disclosure is not limited to the above-described exemplary embodiments and driving configuration examples but, for example, the above-described exemplary embodiments and driving configuration examples may be appropriately combined. It is will be obvious for one of ordinal skill in the art that, in light of the above teachings, different exemplary embodiments and variations are possible according to need and use.

The image forming apparatus recited in appended claims is not limited to the above-described inkjet recording apparatus 100 but is applicable to, for example, an image forming apparatus including an inkjet recording apparatus in, for example, a printer, a plotter, a word processor, a facsimile machine, a copier, or a multi-functional device having two or more of the foregoing capabilities. Furthermore, recording media or sheets are not limited to the paper sheets P but may be thin to thick sheets, postcards, envelopes, OHP sheets, or any other type of recording media or sheets on which images can be formed according to inkjet recording methods.

What is claimed:

1. An image forming apparatus comprising:

a plurality of rotary members:

a conveyance belt looped around the plurality of rotary members so as to circulate to intermittently feed a sheet in a sheet transport direction;

an image forming device disposed opposing the conveyance belt to form an image on the sheet fed by the conveyance belt; and a switchback device disposed adjacent to the conveyance belt and downstream from the image forming device in the sheet transport direction to feed the sheet having passed the image forming device to a position downstream from the conveyance belt in the sheet transport direction and switch back the sheet again to the conveyance belt disposed adjacent to the switchback device, wherein the switchback device includes plural pairs of output rollers, the plural pairs being serially arranged relative to each other in the sheet transport direction and being configured to rotate in the same direction, wherein, when the sheet is attached by the conveyance belt and nipped by the output rollers at the same time, a drive start timing of the output rollers is delayed from a drive start timing of the conveyance belt, and the sheet is maintained in a bent state between the output rollers and the conveyance belt by not starting driving of the output rollers for a predetermined time after a leading edge of the sheet arrives at the output rollers, and wherein after the predetermined time passes, driving of the switchback device is started at the same speed as the conveyance belt, and the sheet is conveyed by the conveyance belt and the switchback device while the sheet is maintained in the bent state.

2. The image forming apparatus of claim 1, wherein the drive start timing of the switchback device is set to be within an acceleration period in starting driving of the conveyance belt.

3. The image forming apparatus of claim 1, wherein the drive start timing of the switchback device is delayed from an acceleration period in starting driving of the conveyance belt.

4. The image forming apparatus of claim 1, wherein a driving time of the switchback device is less than a driving time of the conveyance belt.

5. The image forming apparatus of claim 1, wherein the switchback device includes a transport passage, the transport passage having a sheet bending portion to allow bending of the sheet.

6. The image forming apparatus of claim 1, wherein driving speed of the conveyance belt is equal to driving speed of the switchback device.

7. The image forming apparatus of claim 1, wherein, during image formation of the image forming device, the switchback device feeds the sheet.

8. The image forming apparatus of claim 1, wherein, when the sheet is attached by the conveyance belt and nipped by the switchback device at the same time, a drive stop timing of the switchback device is same as a driving stop timing of the conveyance belt.

9. The image forming apparatus of claim 1, wherein, when the sheet is fed by the conveyance belt and the switchback device, a drive stop timing of the switchback device is during driving of the conveyance belt.

10. The image forming apparatus of claim 1, wherein the switchback device comprises a pair of guides opposing each other.

11. The image forming apparatus of claim 1, further comprising:

a duplex feed roller opposing an opposing rotary member amongst the plurality of rotary members; and a guide to feed the sheet switched back into a nipping portion of the conveyance belt between the duplex feed roller and said opposing rotary member.

* * * * *